United States Patent [19]

Jung

[11] Patent Number: 4,617,737

[45] Date of Patent: Oct. 21, 1986

[54] MACHINE FOR CUTTING OUT FLAT MATERIAL

[75] Inventor: Rolf Jung, Waiblingen, Fed. Rep. of Germany

[73] Assignee: Krauss u. Reichert GmbH & Co. KG, Fellbach, Fed. Rep. of Germany

[21] Appl. No.: 717,627

[22] Filed: Mar. 29, 1985

[30] Foreign Application Priority Data

Apr. 14, 1984 [DE] Fed. Rep. of Germany ..... 3414123

[51] Int. Cl.[4] ..... B26D 1/06; D06H 7/24

[52] U.S. Cl. ..... 30/273; 30/275; 83/759; 83/781; 83/547; 83/743

[58] Field of Search ..... 83/781, 547, 743, 746, 83/759; 30/273, 275

[56] References Cited

U.S. PATENT DOCUMENTS

| | | | |
|---|---|---|---|
| 1,663,267 | 3/1928 | Colby | 30/275 X |
| 2,998,651 | 9/1961 | Gronemeier et al. . | |
| 4,092,777 | 6/1978 | Jung | 30/273 |

FOREIGN PATENT DOCUMENTS

| | | | |
|---|---|---|---|
| 0057782 | 5/1981 | European Pat. Off. . | |
| 0089006 | 3/1983 | European Pat. Off. . | |
| 3208746 | 3/1982 | Fed. Rep. of Germany . | |
| 350875 | 6/1908 | France . | |
| 2345054 | 10/1977 | France . | |
| 2103987 | 3/1983 | United Kingdom | 30/275 |

*Primary Examiner*—Donald R. Schran

*Attorney, Agent, or Firm*—Neuman, Williams, Anderson & Olson

[57] ABSTRACT

A machine for cutting out flat material comprising a support for the flat material, a carriage guided for displacement along the support by at least one guide rail, the carriage bearing a beam extending above the support and pivotable, in relation to the carriage, about an at least approximately vertical, first pivot axis, this beam having at least two arms interconnected by a joint having a second pivot axis parallel to the first pivot axis and the outer arm of said two arms bearing a cutting mechanism pivotable, in relation to the outer beam arm, about a third pivot axis parallel to the first pivot axis and a foot of the cutting mechanism being in contact with the support during operation. In order to simplify the construction of the beam but still ensure that the cutting mechanism always rests perpendicularly on the support, this cutting mechanism is adapted to swivel, in relation to the support, about a tilt axis parallel to the support and rests with its foot on this support.

7 Claims, 4 Drawing Figures

MACHINE FOR CUTTING OUT FLAT MATERIAL

The invention relates to a machine for cutting out flat material, in particular a machine for cutting out cloth, comprising a support for the flat material, a carriage guided for longitudinal displacement along the support by at least one guide rail, the carriage bearing a beam extending above the support and pivotable, in relation to the carriage, about an at least approximately vertical, first pivot axis, the beam having at least two arms interconnected by a joint having a second pivot axis parallel to the first pivot axis and the outer arm of these two arms bearing a cutting mechanism pivotable, in relation to the outer beam arm, about a third pivot axis parallel to the first pivot axis and a foot of the cutting mechanism being in contact with the support during operation.

A cutting-out machine of this type is known from German laid-open application No. 27 03 066. The carriage of this machine is guided on two guide rails and rigidly secured to an upwardly extending upright provided with the first pivot axis for the beam. Carriage, upright and beam are of an extremely stable construction because they are intended to hold the cutting mechanism designed as a slitting blade mechanism over the support designed as a table such that the foot of the slitting blade mechanism is relieved of the weight of this mechanism and just touches the support. The spring suspension of the slitting blade mechanism from the beam, in a vertically adjustable bearing, also serves this purpose.

Since the known cutting-out machine must be of an extremely stable construction with regard to the guide means for the carriage, the upright and the beam arms due to the requirement that the foot of the cutting device is to be relieved of the weight of the slitting blade mechanism and the beam but is nevertheless to slide over the support, the machine is also relatively expensive.

The object underlying the invention is to develop a cheap cutting-out machine of the type described above, based on the consideration that the most important feature of such a cutting-out machine is firstly that the cutting element of the cutting mechanism is always held perpendicularly to the support in order to avoid diagonal cuts when working with a pile of flat material layers and thereby to avoid differences in the sizes of the cut parts. "Perpendicular" is intended to mean, in the case of a slitting blade mechanism, merely that the plane defined by the slitting blade and its direction of feed is at right angles to the plane defined by the surface of the support even though a construction is preferred, in which the forward cutting edge of the slitting blade always extends at least approximately at right angles to the support. In accordance with the invention, this object is accomplished in that the cutting mechanism is adapted to swivel, in relation to the support, about a tilt axis parallel to the support and rests with its foot on this support. In order to ensure that the foot of the cutting mechanism always rests on the support even when the construction is not absolutely resistant to bending between the guide means for the carriage and the pivot bearing for the cutting mechanism, the tilt axis may be provided anywhere between the support and the cutting mechanism. For example, two guide rails for guiding the carriage could be provided on a carrier means which may swivel, relative to the support, about the tilt axis or the outer beam arm could consist of two parts connected via the tilt axis. When the cutting-out machine has a carriage bearing an upright on which the beam is mounted, it is however recommended that the construction be designed such that the upright may swivel about the tilt axis, the latter being located approximately on a level with the support surface. Two simple constructional variations may be used in this respect. In the first variation, the carriage is held on the guide rail so as to be tiltable. In the second, the upright has two parts connected via the tilt axis. In the case of the inventive cutting-out machine it is merely necessary to provide sufficiently stable pivot joints which prevent any lateral tilting back and forth of the cutting mechanism on its foot. On the other hand, the beam arms and the upright, for example, may be produced from light, cheap light-metal sections since they do not carry the cutting mechanism but merely prevent it from tilting.

If the foot of the cutting device is to be relieved of the weight of, for example, the slitting blade mechanism, a beam-like counterweight may be provided on the tiltable region of the upright, opposite the beam, and the tilting moment of this counterweight is preferably adjustable.

Additional features, advantages and details of the invention are given in the following specification as well as in the attached drawings of several preferred embodiments of the invention. In the drawings, FIG. 1 is a front view of a first embodiment of the inventive cutting-out machine, seen in the direction of displacement of the carriage;

Figure 1:
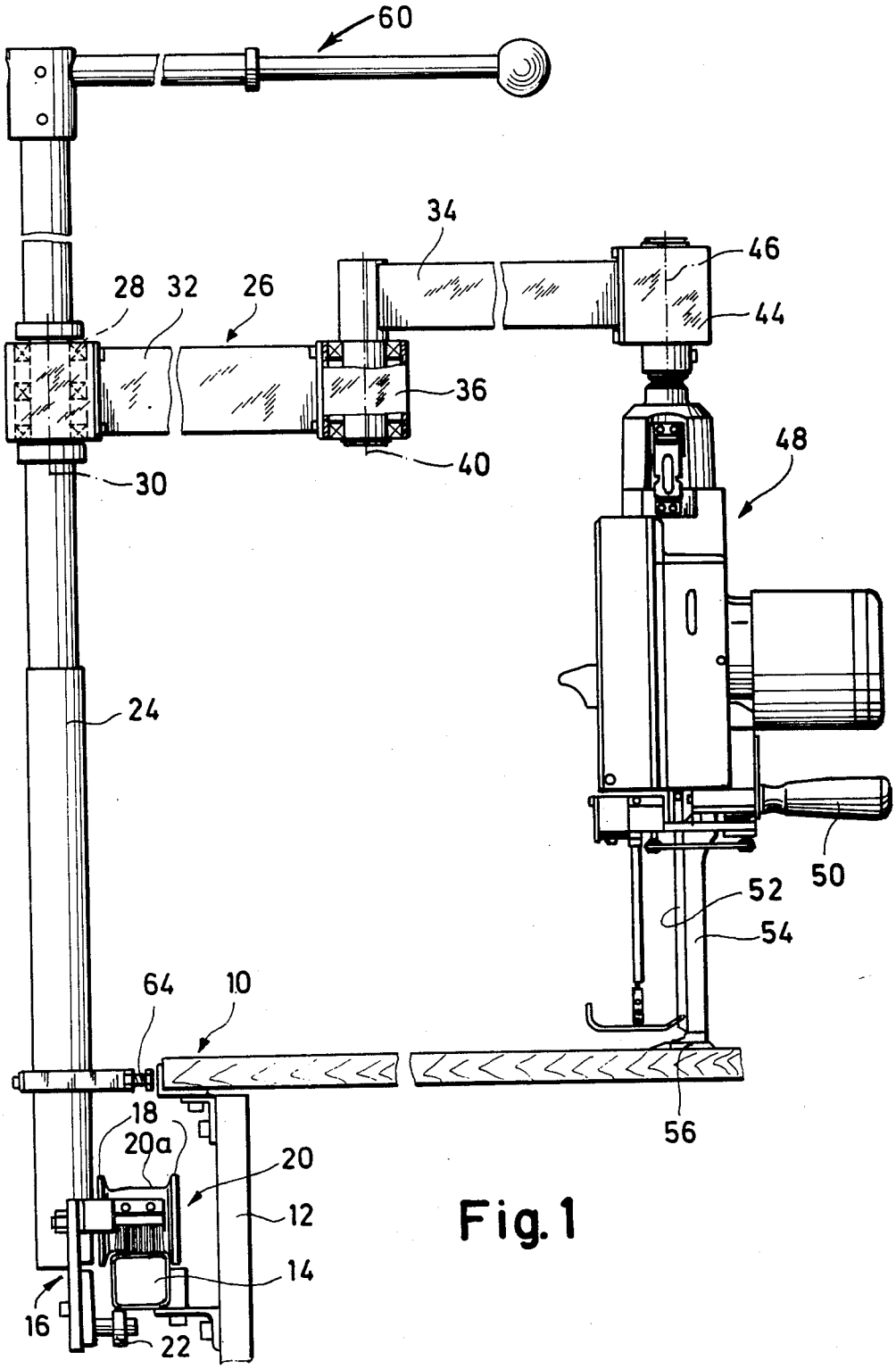

FIG. 1 shows a tabletop serving as a support 10 and carried by a frame 12 which is only partially illustrated. A guide rail 14 formed by a square sectional tube is securely mounted on this frame and, favourably, only slightly beneath the support 10. The guide rail extends in the longitudinal direction of the support 10 and a carriage 16 of a cutting-out machine is guided for displacement along this rail. The carriage has two bearing rollers 20 provided with flanges 18 and arranged one behind the other. These rollers, of which only the bearing roller facing the observer may be seen in FIG. 1, roll along the upper side of the guide rail 14. The carriage also has at least one support roller 22 which rolls along the underside of the guide rail 14.

An upright 24 is rigidly mounted on the carriage 16. A beam designated as a whole as 26 is rotatably mounted on this upright by a first pivot bearing 28. The latter defines a first pivot axis 30 which extends at least approximately at right angles to the surface formed by the support 10 during operation of the cutting-out machine. The beam 26 extends above the support 10 and comprises an inner and an outer beam arm 32 or 34 as well as a second pivot bearing 36 with a pivot axis 40 which extends at right angles to the supoort 10 and articulatedly connects the two beam arms with one another. At its outer end, the beam arm 34 is provided with a third pivot bearing 44, the pivot axis of which also extends at right angles to the support 10. A conventional electric slitting blade mechanism 48, as described in German laid-open application No. 27 03 066, is suspended from and rotatably mounted in this pivot bearing. This mechanism has a guide handle 50, a support 54 designed as a guide means for the slitting blade 52 oscillating in a vertical direction as well as a base plate 56 secured to the lower end of the support. The cutting-out machine rests on the support 10 by means of this base plate.

It is particularly favourable for a rigid arm or beam 60 to be mounted on the upright 24, whereby "rigid" is merely intended to mean that the beam 60 is not intended to pivot about a vertical axis. It also extends over the support 10 and may, in the preferred, embodiment, be adjusted to the width of the support 10 due to its telescopic construction. The carriage 16 may be moved back and forth along the support by means of the arm 60, by an operator standing to the right of the support 10 in FIG. 1.

In the embodiment of FIG. 1, the carriage 16, the upright 24 and the beam 26 may be tilted to a limited extent about the guide rail 14, as will now be explained on the basis of FIG. 2.

The bearing rollers 20 have a rolling surface 20*a* which is designed to be cambered at one side and forms, in axial section, two circular arcs, the centre of curvature of which has been designated as 20*b* and the radius as R. The support roller 22 is laterally offset in relation to the centre of curvature 20*b*. This enables the carriage 16 and the upright 24 to be tilted, despite the use of a square sectional tube, out of their position shown in FIG. 1 and through a limited angle about the guide rail 14 in a counterclockwise direction (vide the tilted position illustrated in FIG. 2 by a dash-dot line).

As already mentioned, it is only important that the slitting blade mechanism 48, in the position shown in FIG. 1, cannot tilt forwards or backwards about the base plate 56.

Since the slitting blade mechanism 48 is intended to be detachably secured to the beam 26, a preferably adjustable stop 64 is to be mounted on the upright 24. This may have, in particular, the form of a bolt with check nut and is intended to prevent the beam 26 tilting downwards towards the support 10 once the slitting blade mechanism has been removed. During normal operation, the stop 64 is, however, intended to be only slightly spaced from the support 10 or the frame 12. A further advantage of the stop 64 is the fact that the beam 26 and the slitting blade mechanism 48 do not tilt downwards to any great extent should the slitting blade mechanism run out beyond the side of the support 10.

Figure 2:
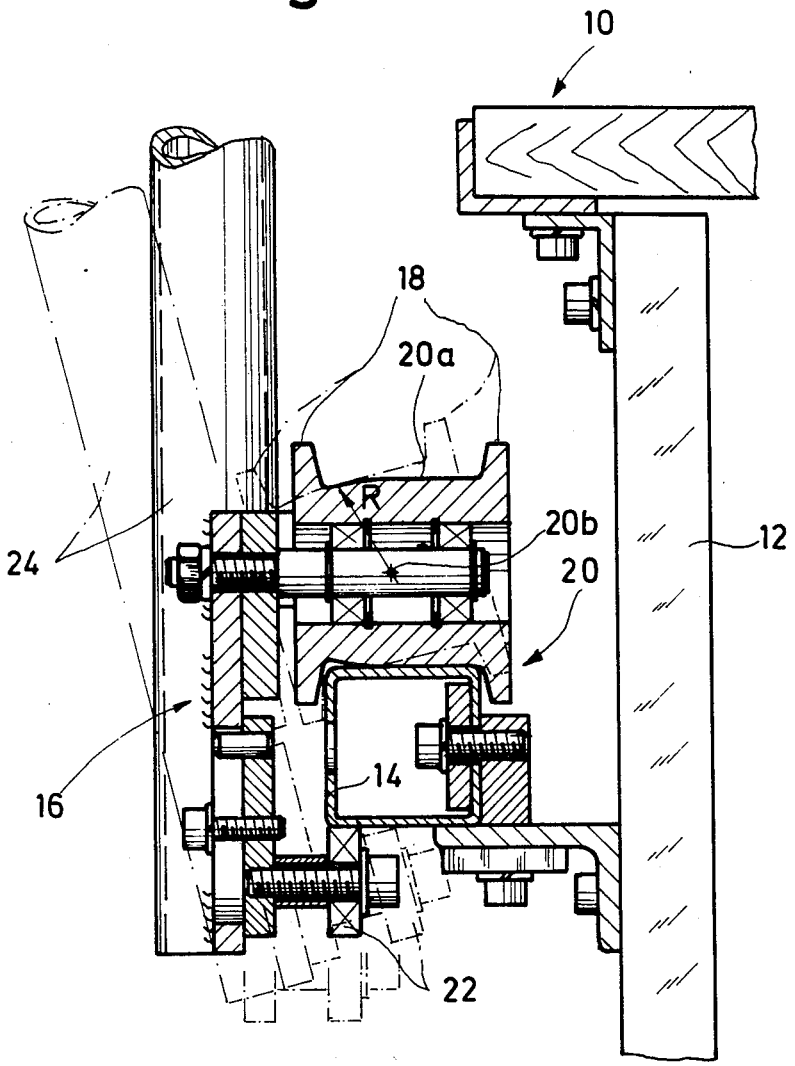
FIG. 2 shows the carriage guide means of the cutting-out machine of FIG. 1 on a larger scale.
Figure 3:
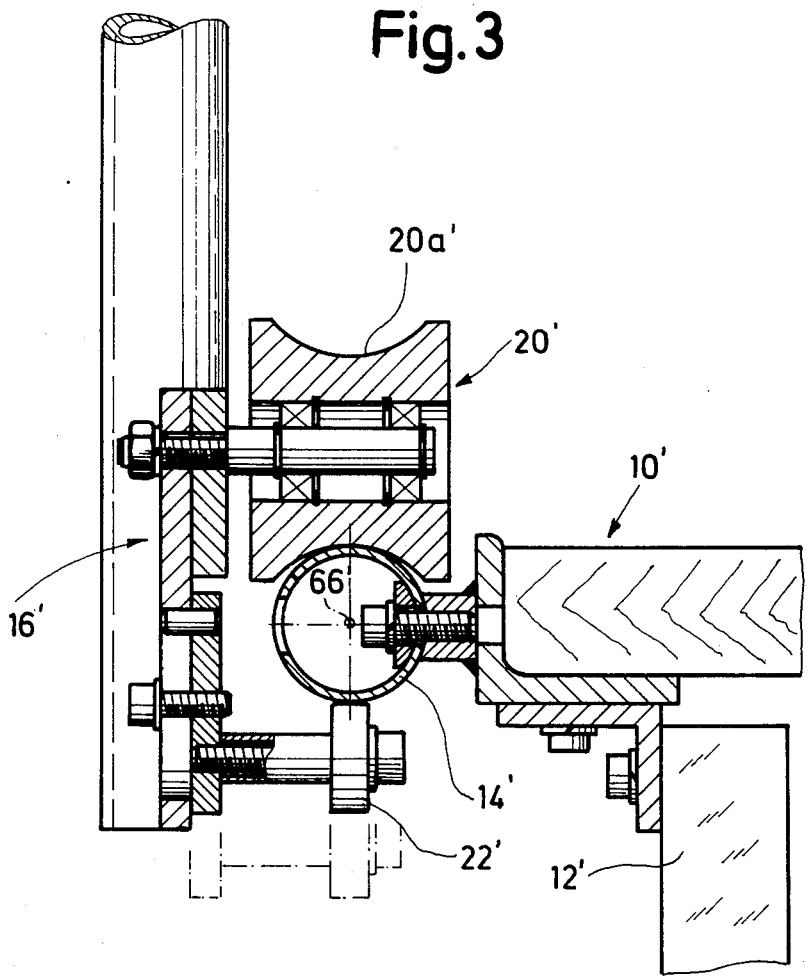
FIG. 3 shows an alternative carriage guide means in an illustration corresponding to the illustration of FIG. 2.

The embodiment of FIG. 3 differs from the embodiment of FIGS. 1 and 2 only in the type of guide means provided for carriage 16'. In the cutting-out machine of FIG. 3, a guide rail 14' having a circular cross section is secured to a frame 12' for a support 10' on a level with the support 10. The carriage has two bearing rollers 20' having, in cross section, curved rolling surfaces 20*a'*, the curvature of of which is adapted to the outer radius of the guide rail 14'. The carriage 16' has at least one support roller 22' which is centrally located beneath the bearing rollers 20' so that the carriage may tilt about the longitudinal centre axis of the guide rail 14'. A particular advantage of this embodiment is the fact that the tilt axis 66' is located only very slightly beneath the surface of the support 10'.

Figure 4:
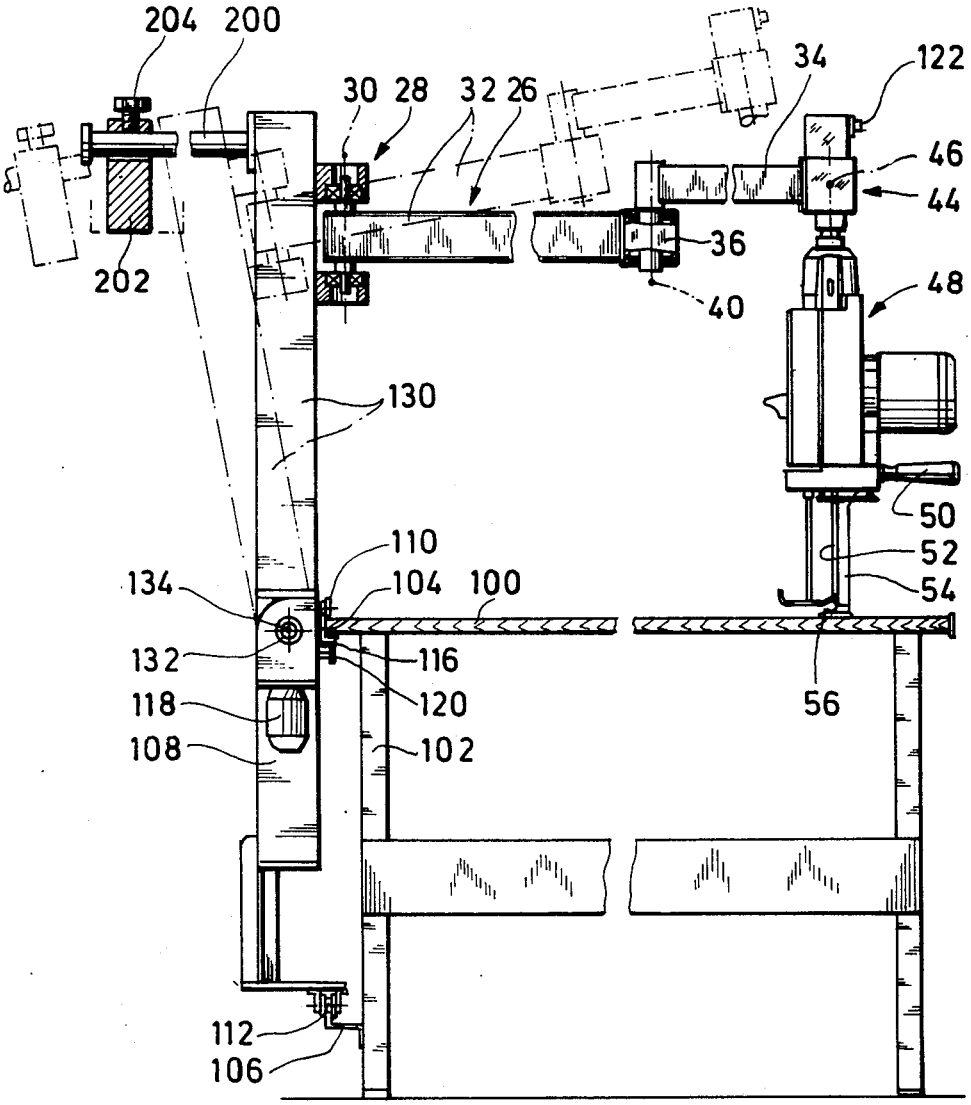
FIG. 4 is an illustration of a third embodiment of the inventive cutting-out machine corresponding to the illustration of FIG. 1.

In the embodiment of FIG. 4, an upper and a lower guide rail 104, 106 for a carriage 108 are mounted on a frame 102 carrying a support 100. The carriage has two bearing rollers 110 for guide rail 104 and two support rollers 112 for guide rail 106. A toothed rack 116 is secured to the frame 102 beneath the guide rail 104 and is engaged by a pinion 120 driven by an electric geared motor 118. This motor 118 may be switched on and off and its direction of rotation changed by an electric switch 122 which is mounted over the slitting blade mechanism 48.

In the embodiment of FIG. 4, an upright 130 is articulatedly mounted on the carriage 108 via a rocker bearing 132 having a horizontal tilt axis 134 extending at right angles to the plane of drawing in FIG. 4. The beam 26 is mounted on the upright via a first pivot bearing 28. The design of this beam can be the same as for the embodiment of FIG. 1. For this reason, the same reference numerals as in FIG. 1 have been used for its parts and a more detailed description may be dispensed with. FIG. 4 finally shows a possibility of relieving the weight burden on the support 54. A supporting arm 200 is mounted on the side of the upright 130 remote from the beam 26 and a counterweight 202 is displaceable along this arm. A setscrew 204 serves to fix the counterweight in a position in which the base plate 56 rests on the support 100 with only very slight force. The supporting arm 200 may be kept relatively short, depending on the size of the counterweight 202.

It should also be pointed out that the first pivot bearing, e.g. the pivot bearing 28 in the embodiment of FIG. 1, could also be provided between the carriage and the upright even though an embodiment of this type is not preferred because it would then no longer be possible to displace the carriage along the support with the aid of the rigid arm 60.

In the embodiment of FIG. 4, the rocker bearing 132 could also be placed somewhat higher or the upright 130 could extend downwards to below the support 100 so that the upright consists of two parts pivotally connected with one another via the rocker bearing.

Particularly favourable are all those embodiments, with which the tilt axis, which extends approximately horizontally and about which the beam carrying the cutting mechanism is pivotable, is approximately on a level with the support for the flat material or slightly above or below it. Production tolerances relating to the position of the tilt axis with regard to height are then of very minor importance. If both an upper and a lower guide means are provided for the carriage, e.g. the elements 20 and 22 of the embodiment in FIGS. 1 and 2 or the elements 104 and 106 or 110 and 112 of the embodiment in FIG. 4, it is recommended that the tilt axis be arranged approximately on a level with the upper carriage guide means. It is also advantageous to position the upper carriage guide means approximately on a level with the support for the flat material. If the tilt axis is approximately on a level with the support for the flat material, it is not important for the carriage bearing the beam to be guided exactly.

If the carriage bearing the beam is tiltable together with the beam, the carriage can be constructed much more simply and easily and it need no longer be held on its guide means as stably and exactly as is the case for the known cutting-out machines of the type in question.

I claim:

1. A machine for cutting flat material, comprising a support having an upper surface for supporting such flat material to be cut; guide means mounted on said support and extending along one side thereof; a carriage supported by said guide means for movement along said one side of said support; a tiltable upright mounted on said carriage; a beam supported by said tiltable upright extending over the upper surface of said support; said beam having at least an inner and an outer beam section; said inner beam section being pivotally mounted at one end along a first pivot axis to said tiltable upright; a first bearing for pivotally mounting said inner beam section on said tiltable upright; a second bearing for pivotally connecting ends of the outer beam section and the inner beam section along a second pivot axis; cutting means pivotally mounted on a distal end portion of said outer beam section; a third bearing for pivotally mounting said cutting means on the distal end portion of said outer beam section along a third pivot axis; said cutting means having a foot for resting on the upper surface of said support; said first, second and third pivot axes being substantially vertically disposed to said support upper surface when said foot contacts said upper surface; said carriage having mounting means for mounting said carriage on said guide means and for cooperative engagement with the guide means in such manner that said upright is tiltable about a tilt axis parallel to said support upper surface.

2. A machine for cutting flat material, comprising a support having an upper surface for supporting such flat material to be cut; guide means mounted on said support and extending along one side thereof; a carriage supported by said guide means for movement along said one side of said support; a tiltable upright mounted on said carriage; a beam supported by said tiltable upright extending over the upper surface of said support; said beam having at least an inner and an outer beam section; said inner beam section being pivotally mounted at one end along a first pivot axis to said tiltable upright; a first bearing for pivotally mounting said inner beam section on said tiltable upright; a second bearing for pivotally connecting ends of the outer beam section and the inner beam section along a second pivot axis; cutting means pivotally mounted on a distal end portion of said outer beam section; a third bearing for pivotally mounting said cutting means on the distal end portion of said outer beam section along a third pivot axis; said cutting means having a foot for resting on the upper surface of said support; said first, second and third pivot axes being substantially vertically disposed to said support upper surface when said foot contacts said upper surface; means on said carriage for pivotally mounting said tiltable upright relative to said support surface whereby said tiltable upright is tiltable about a tilt axis parallel to said top surface.

3. The machine of claim 1 or 2, wherein said tilt axis is disposed parallel to said one side of the support.

4. The machine of claim 1 or 2, wherein said tilt axis is located on a level with said upper surface.

5. The machine of claim 1 or 2, wherein said upright has a counterweight mounted thereon oppositely disposed to said beam.

6. The machine of claim 5, wherein said counterweight is in the form of a beam.

7. The machine of claim 5 or 6, wherein said counterweight has a weight and weight guide means fixed to and extending transversely to the upright; said weight being slidably mounted on said guide means, and means for fixing the weight body in position on said guide means.

* * * * *